United States Patent [19]

Risser

[11] Patent Number: 4,582,102

[45] Date of Patent: Apr. 15, 1986

[54] MEANS FOR ELECTRONICALLY COMPARING THE EXTENT OF FILL IN CONTAINERS WITH A PRESET EXTENT

[76] Inventor: James A. Risser, 201 Cherokee Rd., Charlotte, N.C. 28207

[21] Appl. No.: 644,332

[22] Filed: Aug. 27, 1984

[51] Int. Cl.[4] ..... B65B 3/04

[52] U.S. Cl. ..... 141/95; 141/144; 141/153; 141/198

[58] Field of Search ..... 141/1-12, 141/37-66, 99, 114, 67, 68, 313-317, 83, 129-191, 192-229, 94, 95, 96

[56] References Cited

U.S. PATENT DOCUMENTS

| | | | |
|---|---|---|---|
| 3,093,165 | 6/1963 | Risser | 141/140 |
| 3,578,038 | 5/1971 | Burford | 141/59 |
| 3,786,844 | 1/1974 | Smearsoll | 141/196 |
| 3,892,264 | 7/1975 | Held | 141/99 |
| 4,038,531 | 7/1977 | Loe | 141/83 |
| 4,092,721 | 5/1978 | Rueff | 141/196 |
| 4,230,195 | 10/1980 | Graffin | 141/83 |
| 4,272,824 | 6/1981 | Lewinger | 141/83 |

*Primary Examiner*—Houston S. Bell, Jr.
*Attorney, Agent, or Firm*—Shefte, Pinckney & Sawyer

[57] ABSTRACT

A rotary filling machine having a rotating platform with stations on which bottles are supported for filling with liquid dispensed through filling head assemblies at each individual station. A master electronic circuit mounted on the rotating platform is connected to separate station electronic circuits for distribution of selected electronic signals received from a non-traveling, settable circuit. Each electronic circuit compares the signal corresponding to the sensed extent of fill determined by a sheer beam strain gauge load cell at each station and provides an electrical signal to the valve control in response to the comparison to cause the valve to close to stop filling the container at the station. The fill is, thereby, stopped immediately and accurately in response to the sensing to the sensing andin comparison with a set fill extent, with each station being controlled separately without dependence on or delay resulting from operation or sensing by the controls at other stations, with the electronic controls being isolated from any extraneous effects of crossing moving/non-moving interfaces, and being capable of individual intelligence determinations for control and compensating adjustment of filling operations as they are taking place as well as for subsequent filling operations at the same station during subsequent cycles.

51 Claims, 15 Drawing Figures

MEANS FOR ELECTRONICALLY COMPARING THE EXTENT OF FILL IN CONTAINERS WITH A PRESET EXTENT

BACKGROUND OF THE INVENTION

The present invention relates to means for indicating the extent of fill of containers in a container handling apparatus, and more particularly to means for indicating the extent of fill of containers traveling on individual container stations of the conveyor in comparison with a preset selected fill extent.

Accuracy in filling and sensing the extent of fill in containers is a critical aspect of most container filling operations because intentional, but expensive, overfilling must be programmed into the operation to assure that substantially all of the containers are filled to a required minimum. Therefore, accurate and fast sensing of the extent of fill is desirable to facilitate detection of fill variations so that, for example, compensations can be made in the filling of the container being checked or in filling subsequent containers.

There is also an increasing demand for faster production in filling operations to reduce cost and increase efficiency, for which purpose it is almost a necessity that the extent of filling be sensed as the containers are traveling, rather than stopped in an otherwise continuously moving operation. Thus, it is desirable that the sensing occur on traveling container stations, but this presents problems of accuracy and reliability of results where the controls for the sensing must, as in the case of sophisticated and potentially accurate electronic controls, have components on the traveling station connected to non-travelling components or where there are a number of traveling sensing stations that must be related.

For example, in apparatus for filling containers as they travel sequentially on container stations of an endless conveyor, such as in a rotary filling machine, it would be advantageous to be able to sense the extent of fill accurately during the filling operation and compare the sensed extent to determine when to stop filling. This could be done with mechanical, hydraulic or pneumatic controls, but with a substantial and undesirable sacrifice in speed due to the relative slow action of such systems, but electrical systems, while faster acting, have not been able to be used to their accuracy, fast response and versatility potential in systems where the sensing is occurring at a sequence of traveling container stations.

SUMMARY OF THE INVENTION

The present invention overcomes the problems of the prior art by providing electronic controls that act reliably, accurately and with the speed of electronics to sense the extent of fill at individual traveling container stations in a manner that provides an immediate accurate indication that can be used, for example, to control a filling operation that may be taking place during the sensing.

Basically, the means for indicating the extent of fill in containers according to the present invention is incorporated in a container handling apparatus having an endless conveyor onto which the containers are sequentially placed and transported on individual container stations of the conveyor. The means for providing an indication of the extent of fill does so in comparison with a preset selected fill extent. The means includes a separate means traveling with each individual container station for sensing the extent of fill of the container at the station and providing a corresponding electrical signal. A separate electronic circuit means travels with each individual container station for receiving the signal from the sensing means at the same station. A non-traveling electrical means is included separate from the conveyor and is selectively settable to provide an electrical signal corresponding to a desired extent of fill for the containers, with means electrically connecting this non-traveling electrical settable means with each of the traveling separate electronic circuit means to transmit the selected electrical signal to each of the separate electronic circuit means, which compare the electrical signal corresponding to the sensed extent of fill with the selected electrical signal and provides an electrical signal in response to this comparison. With this arrangement the selectively settable electrical signal can be changed during travel of the conveyor and can be transmitted sequentially to each of the separate electronic circuit means, which can include the capability of latching the set desired extent of fill signal until the setting of the signal is changed.

Preferably, commutator means are included to transmit the electrical signals from the non-traveling electrical settable means to the separate electronic circuit means, and regulating means are provided for regulating the electrical signals transmitted from the commutator means to the separate electronic circuit means to minimize extraneously imposed variations in the signals.

While various types of fill indicating means may be utilized, the present invention is particularly applicable to the use of shear beam strain gauge load cells, which have the capability of accurately and reliably sensing the weight of containers supported thereon regardless of off-center positioning of the containers. Accurate measurements in grams or less can be obtained with such load cells even when weighing containers that may be filled to weights of several pounds or more.

The signals from the non-traveling electrical means may be received and effectively transmitted to the separate electronic circuit means by a master electronic circuit means mounted on the conveyor for traveling therewith, thereby providing an effective means for receiving, interpreting and distributing control signals to the separate electronic circuit means.

With the use of separate electronic circuit means traveling with the conveyor at each container station, reliable, accurate and fast comparison signals can be obtained independently of the other containers being sensed, without delay for sensing of other containers and without requiring a connection back to a non-traveling means. Thus, a reliable, and accurate signal is obtained that is immediately available for informational or operational purposes for each container station on a moving conveyor.

When incorporated in an apparatus for filling containers with material that is dispensed from a supply through flow control means into containers traveling sequentially on individual container stations of an endless conveyor, the controlling means of the present invention is adapted to control the flow control means to stop filling of each container in relation to a preset selected fill extent. In this form, the controlling means includes separate means traveling with each individual container station for sensing the extent of fill of the container at the station and providing a corresponding electrical signal, a separate electronic circuit means traveling with each individual container station for receiving the signal from the sensing means at the same station, and means providing an electrical signal corresponding to desired extent of fill for the containers, with the separate electronic circuit means comparing the electrical signal corresponding to the sensed extent of fill with the electrical signal corresponding to the desired extent of fill and providing an electrical signal to the flow control means in response to the comparison to cause the flow control means to stop filling the container at the station. All of the features previously mentioned can be incorporated in this embodiment, and it can further compare the electrical signal from the sensing means after filling has stopped with the preset signal and apply a corresponding compensating adjustment to the subsequent electrical signal to the flow control means. To compensate for extraneous fluctuations in the sensing of the fill extent, the compensating adjustment may be determined to correspond to the average difference indicated by a preceding plurality of comparisons, and also may be selected as a portion of the difference obtained by the after filling comparison. Further, to minimize any extraneously caused deviations in the fill extent sensing that could cause stopping of the filling operation before a desired fill has actually occurred, the separate electronic circuit means may be designed to determine the average rate of fill from a plurality of the electrical signals from the sensing means as the signals approach the desired extent of fill signal and provide an electrical signal to the flow control means in response to a comparison of the average rate of fill with the desired extent of fill signal.

In its preferred embodiment, the present invention is incorporated in a rotary filling machine that has a rotating conveyor, preferably a rotating platform, with filling stations on which containers are supported and into which liquid is dispensed through filling head assemblies at each individual station, with the filling head assemblies having valve means for controlling the flow of liquid therethrough. This embodiment includes the aforementioned master electronic circuit means mounted on the rotating conveyor and connected to each of the separate station electronic circuit means for distribution of a selected electronic signal received from a non-traveling electrically settable means. Each separate electronic circuit means compares the electrical signal corresponding to the sensed extent of fill with the electrical signal from the master electronic circuit means corresponding to the desired extent of fill and provides an electrical signal to the valve means in response to the comparison to cause the valve means to close to stop filling of the container at the station. Thus, the fill can be stopped immediately and accurately in response to the sensing and in comparison with a set fill extent, with each station being controlled separately without dependence on or delay resulting from operation or sensing by the controls at other stations, with the electronic controls being isolated from any extraneous effects of crossing moving/non-moving interfaces, and being capable of individual intelligence determinations for control and compensating adjustment of filling operations as they are taking place as well as for subsequent filling operations at the same station during subsequent cycles.

DETAILED DESCRIPTION OF THE PREFERRED EMBODIMENT

Figure 1:
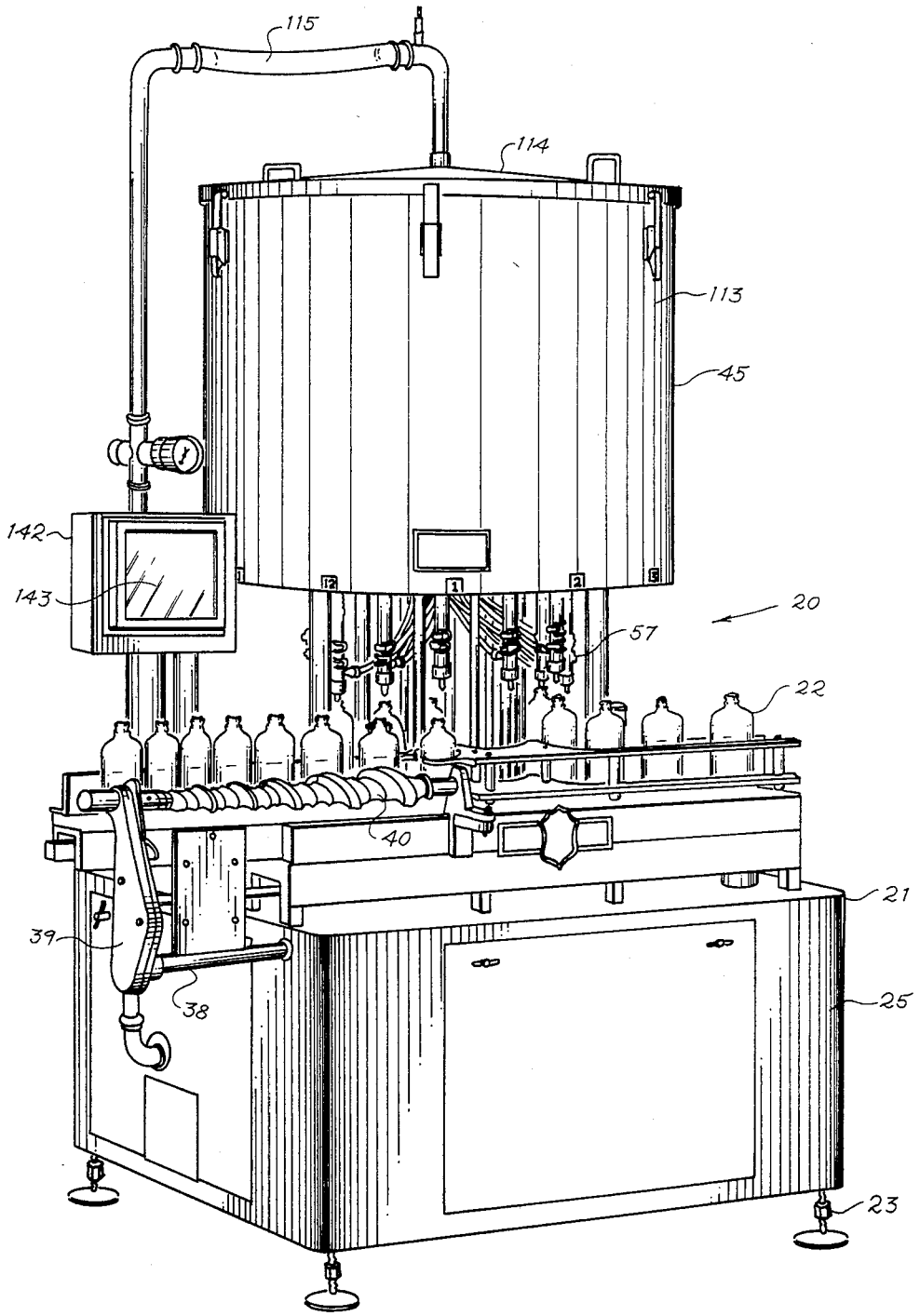
FIG. 1 is a perspective view of a rotary filling machine incorporating the preferred embodiment of the means for providing an indication of the extent of fill in the form of congtrolling means.
Figure 2:
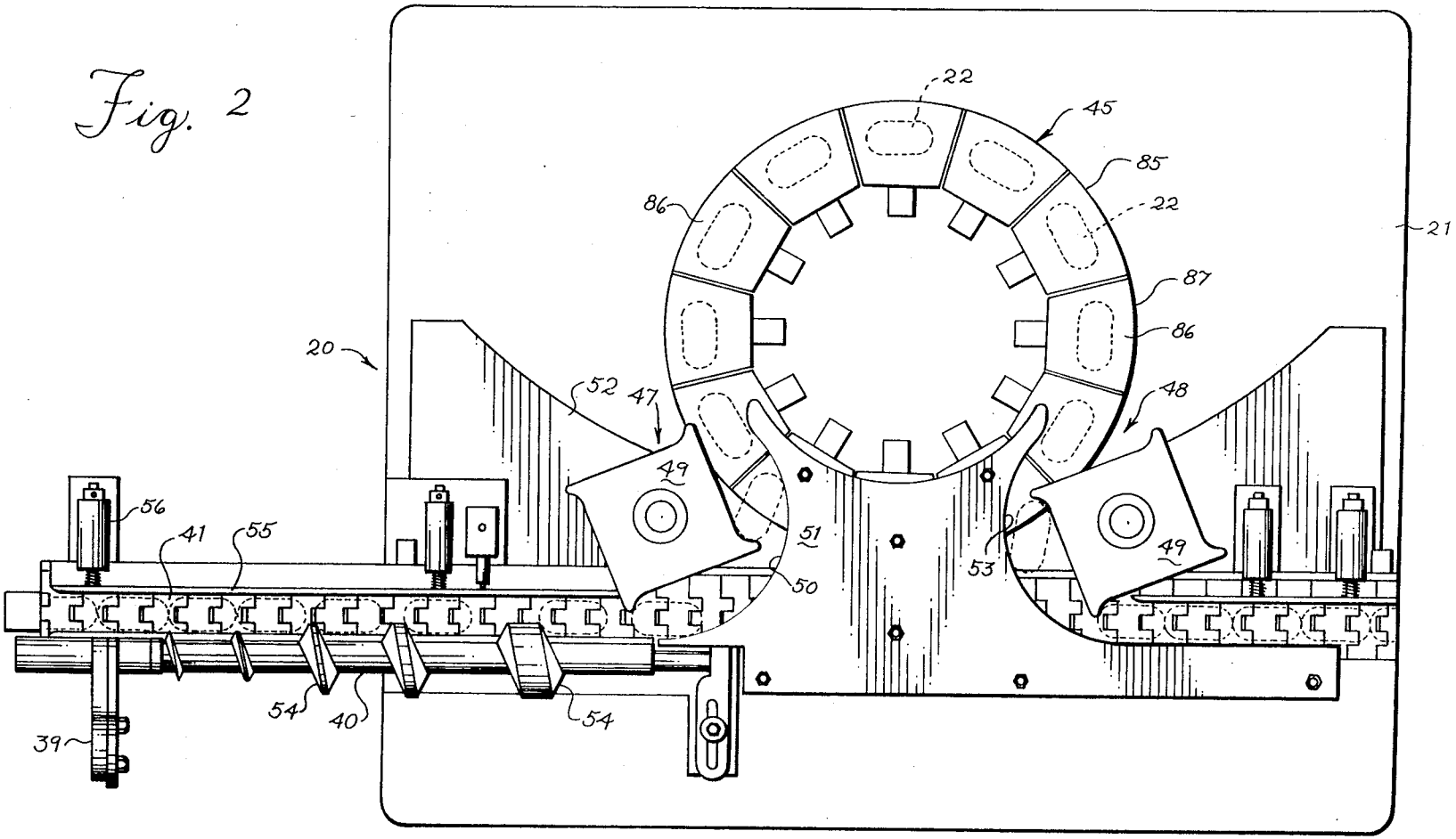
FIG. 2 is a planned view of the conveyor system of the rotary filling machine of FIG. 1.
Figure 3:
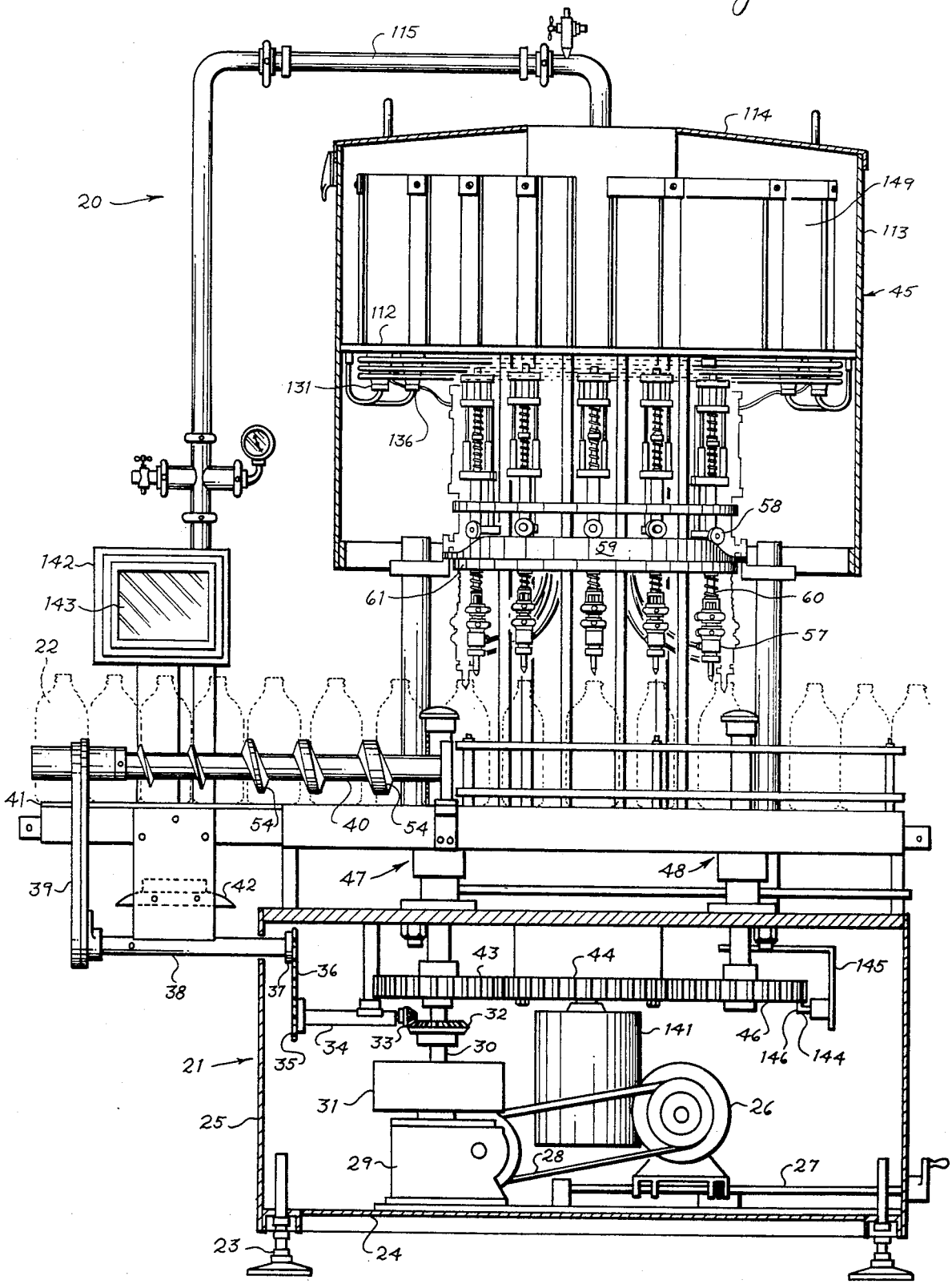
FIG. 3 is a front elevation of the machine of FIG. 1 with housing portions removed and sectioned to provide an illustration of the interior of the machine.
Figure 4:
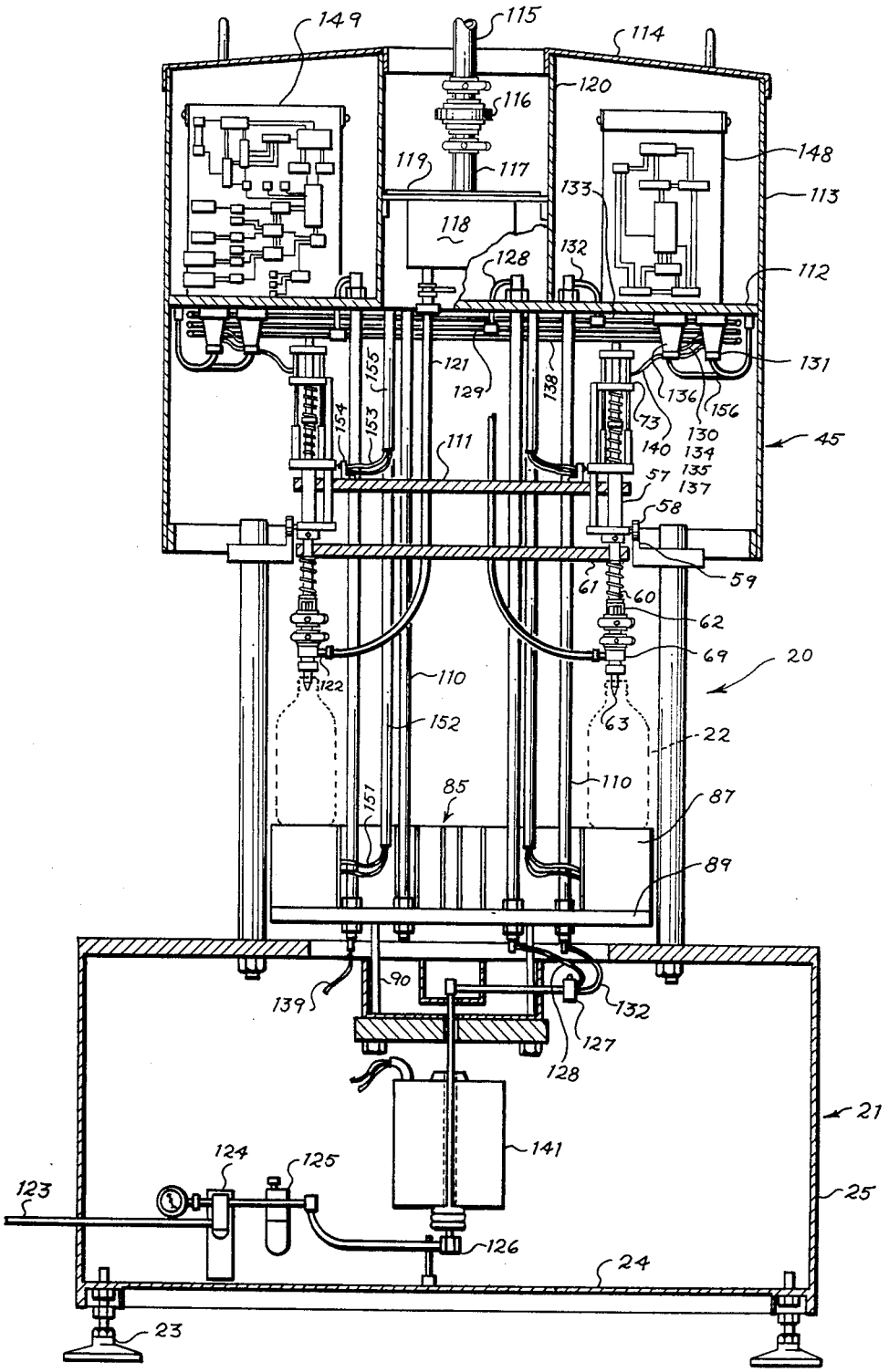
FIG. 4 is a view similar to FIG. 3, but with portions removed for clarity of illustration of the pneumatic, electrical and filling line systems.

The preferred embodiment of the present invention is incorporated in a rotary bottle filling machine 20 that has a base 21 onto which empty bottles 22 are fed from the preceding component of the overall production line (not shown) and from which filled bottles are discharged onto the succeeding component of the production line (not shown).

The base 20, as seen in FIGS. 1–4 is supported on legs 23 that depend from a horizontal base plate 24 on which the components of the machine 20 are supported. The various drive components are mounted directly above the base plate 24 and are enclosed by housing or cabinet 25. These drive components include an electric motor 26 mounted on a slide rod mechanism 27 for tensioning of the drive belt 28 driven by the motor 26 and driving the gear box 29 by which the main drive shaft 30 is driven. The main drive shaft 30 projects vertically from a fitting 31 and carries a bevel gear 32 that drives a pinion 33 connected to a shaft 34 on which a drive sprocket 35 is mounted for driving, through a chain connection 36, a driven sprocket 37 mounted on a cross shaft 38 that drives the drive assembly 39 for a bottle feeding worm 40 mounted above and to the side of the path of a slat conveyor 41 that extends through the machine 20 on the base 21 thereof for conveying bottles 22 to and from the machine 20 in a straight line. To support the return of the conveyor 41, a conveyor bracket 42 is mounted below the bottle conveying path of the conveyor.

The main drive shaft 30 projects upwardly from the bevel gear 32 for a mounting thereon of a spur gear 43 that drives a main drive gear 44 mounted on the underside of a rotating filling assembly 45 to impart rotation thereto. The main drive gear 44 also engages another spur gear 26 opposite the spur gear 43, for synchronous driving by the spur gears 43 and 46 of associated in feed star assembly 47 and discharge star assembly 48 adjacent the path of the conveyor 41. The in feed star assembly 47 includes a star wheel 49 projecting into the path of bottles on the in feed side of the conveyor 41 to advance the bottles 22 along the arcuate surface 50 of a guide plate 51 that causes the bottles to advance from the conveyor over a support plate 52 and onto the rotating filling assembly 45. The other spur gear 46 projects into the path of the bottles 42 after they have finished a filling cycle and advances the bottles along another arcuate surface 53 of the guide plate 51 for removing the bottles from the rotating filling assembly 45 over the support plate 52 and back onto the conveyor 41 for discharge from the machine 20.

The worm 40 has flights 54 that are of increasing depth, width and spacing in the progressing direction of feed so that the flights will progressively separate the bottles 22 as they advance on the conveyor 41 so that they will be in proper position for engagement by the in feed star wheel 49. The bottles 22 are retained in worm engagement by a vertical guide slat 55 that is yeildably mounted by spring mounting assemblies 56 to yieldably urge the bottles 22 into engagement with the worm 40.

This drive system and bottle conveying arrangement is generally conventional in rotary filling machines of this general type, as is the general construction and manipulation of the individual filling head assemblies 57 that are carried on the rotating filling assembly 45 and are manipulated vertically by followers 58 mounted on each filling head assembly 57 and riding on an arcuate cam 59 that raises each filling head assembly 57 after a bottle 22 has been filled and allows lowering of the filling head assembly by the action of a coil spring 60 biased between the underside of a support ring 61 on which the filling head assemblies 57 are mounted and the lower housing 62 of the filling head assembly for seating of the filling head assembly 57 over the opening of the associated bottle 22 with the stem 63 of the filling head assembly 57 extending into the bottle for filling. General arrangements of filling head assemblies in similar manners are disclosed in prior U.S. Pat. No. 3,150,697, No. 3,589,414 and No. 3,605,827, all owned by the assignee of the present invention.

Figure 7:
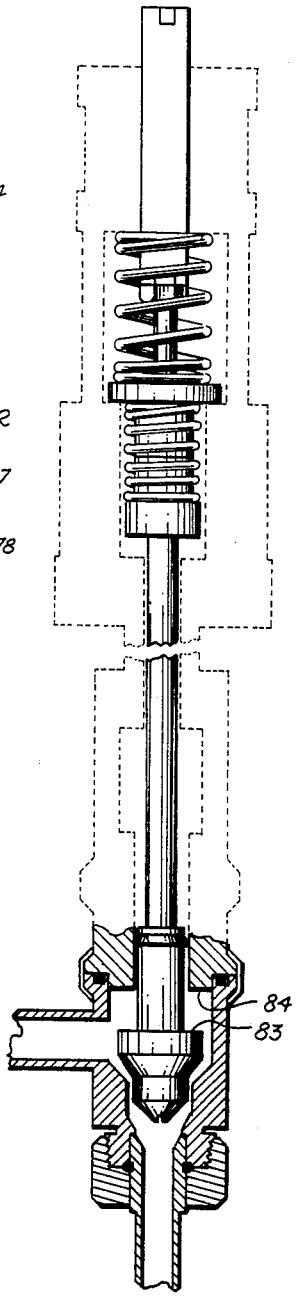
FIG. 7 is a view similar to FIG. 6, but partially in phantom, and illustrating the valve components in the partially closed, final-fill condition.

The filling head assemblies 57 differ from conventional units in that they are constructed and operate to provide the combination of an initial fast filling and a final slow filling, thereby combining the advantages of high filling production rates and accurate sensing of the full fill condition for closing the valve. To accomplish this, the valve seat 64 is formed with a conical section 65 and a cylindrical section 66 extending outwardly therefrom. The valve stem 67 is formed with a conical portion 68 for seating against the conical section 65 to close the valve 69, and has a cylindrical portion projecting therefrom into the cylindrical section 66, with the outer diameter of the cylindrical portion 70 of the valve stem 67 being only slightly less than the inner diameter of the cylindrical section 66 of the valve seat 64 so that the valve can be partially opened with the conical portion 68 unseated but with the cylindrical portion 70 still within the conical section 65 so that liquid flow can take place therebetween, but at a slow rate due to the narrow passage. This is illustrated in FIG. 7.

Figure 8:
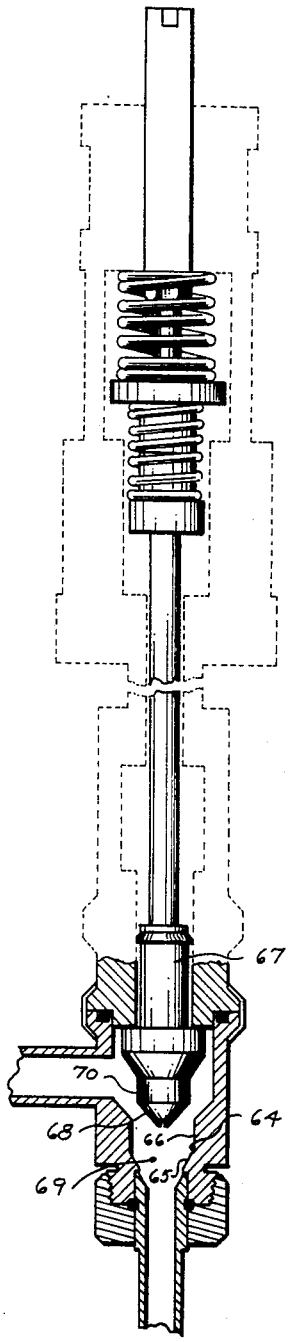
FIG. 8 is a view similar to FIG. 7, showing the valve components in the open, filling condition.

When the valve stem 67 is fully retracted from the valve seat 64, the cylindrical portion 70 of the valve stem 67 is totally withdrawn from the cylindrical section 66 of the valve seat 64 so that full unencumbered flow of liquid can pass through the valve 69. This is illustrated in FIG. 8.

This dual manipulation of the valve 69 is accomplished by using a high compression spring 71 and a low compression spring 72, with air being introduced into the operating cylinder 73 at two different pressures, one being sufficient to overcome the force of both the high compression spring 71 and the low compression spring 72 to open the valve 69 completely, and the other air pressure being only sufficient to overcome the low compression spring 72 to only partially open the valve 69 with the cylindrical portion 70 of the valve stem 67 remaining within the conical section 65 of the valve seat 64 for final slow filling, while the high compression spring 71 is strong enough not to be compressed by the low pressure air.

The high compression spring 71 is mounted between a mounting block 74 at the bottom of the operating cylinder 73 and an annular spring seat 75 that has a flange 76 movably biased by the force of the high compression spring 71 against the top surface of an annular spring stop 77 of a spring base mount 78 from which tie rods 79 extend upwardly to support the operating cylinder 73, and which also supports a hollow slide rod 80 that depends from the spring base mount 78 down to a connection with the valve housing 62. The valve stem 67 extends upwardly from the valve 69 through the hollow slide rod 80 above the spring base mount 78 where it is attached by a ball detent assembly 81 to a stem extension 82 that extends upwardly through the spring seat 75 and into the operating cylinder 73 for manipulation thereby.

The low compression spring 72 is mounted between the underside of the spring seat 75 and the ball detent assembly 81 to normally apply a downward force to the valve stem 67. The parts are related so that when the spring seat 75 is seated on the spring stop 77 and the valve stem 67 is seated on the valve seat 64, there is a spacing between the bottom of the spring seat 75 and the top of the ball detent assembly 81. This spacing is of an extent such that when low pressure air is applied to the operating cylinder 73, the high compression spring 71 will retain the spring seat 75 on the spring stop 77, but the force of the operating cylinder 73 will overcome the force of the low compression spring 72 and draw the valve stem 67 upwardly until the ball detent assembly 81 abuts the bottom of the spring stop 77, closing the space therebetween and raising the conical portion 68 of the valve stem 67 from the conical section 65 of the valve seat 64, while positioning the cylindrical portion 70 of the valve stem 67 in the cylindrical section 66 of the valve seat 64 for low flow rate operation of the valve 69.

When high pressure is applied to the operating cylinder 73, the force of both the high compression spring 71 and low compression spring 72 are overcome and the valve stem 67 is drawn upwardly until an annular flange 83 on the valve stem 67 adjacent the cylindrical portion 70 thereof abuts a downwardly facing surface 84 interiorly on the lower valve housing 62 in the interior of the valve 69, thereby stopping further upward movement of the valve stem 67 and associated parts to position the valve 69 in fully opened position.

Figure 9:
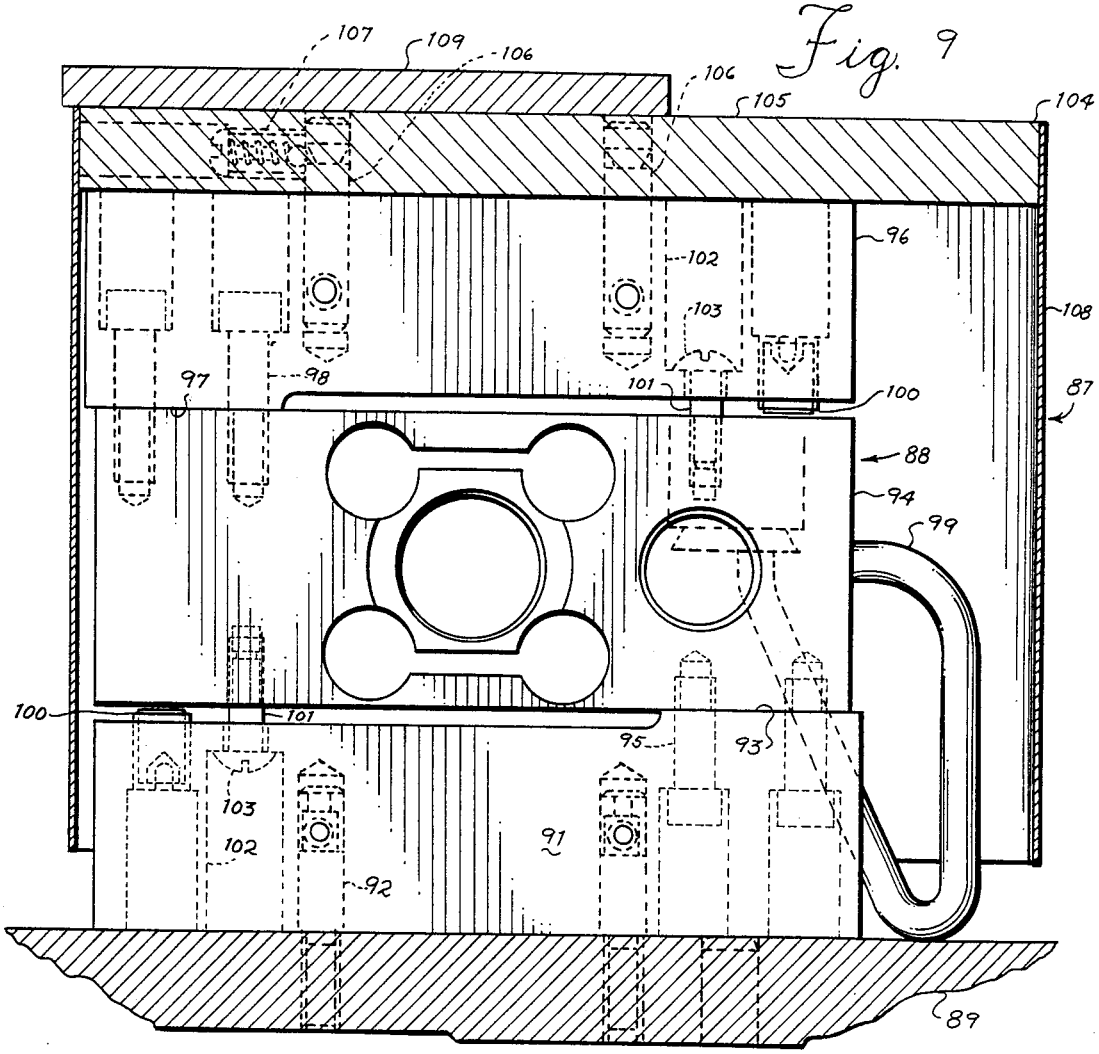
FIG. 9 is an elevation of a load cell shown mounted in place on the machine of FIG. 1, with the component on which it is mounted and the components that are mounted thereon being shown in section.
Figure 10:
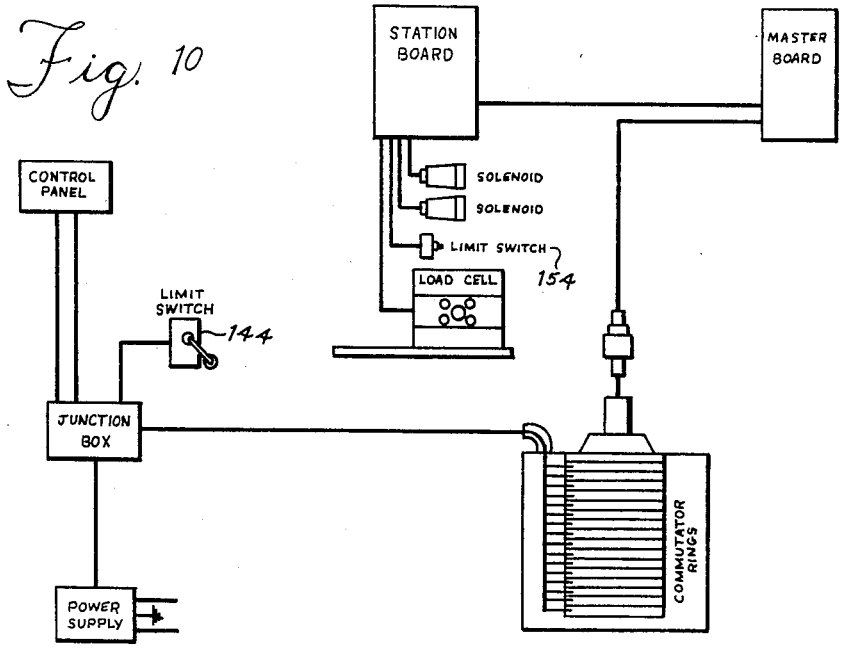
FIG. 10 is a diagrammatic view of the overall electrical system of the machine of FIG. 1.
Figure 11:
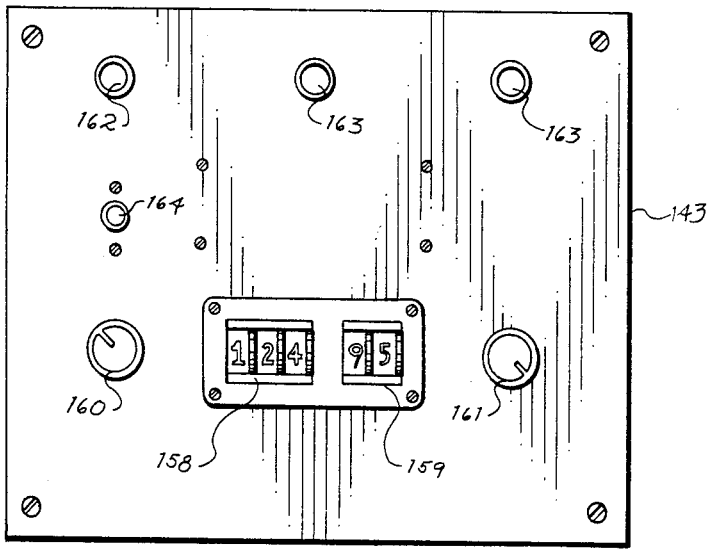
FIG. 11 is an elevation of the operator panel of the machine of FIG. 1.

The rotating filling assembly 45 provides a rotating conveyor for conveying the bottles 22 at individual bottle filling stations 86 that rotate with the assembly. Each station 86 receives a bottle 22 from the star wheel 49 as a result of the synchronous feeding so that one bottle is positioned at each station 86 for filling during the sequence of operations that occurs at that station as it rotates, with the bottles being discharged from the stations by the deflecting action of the other arcuate surface 53 and the discharge star assembly 48. At each station 86 the bottles are fed onto and are supported by bottle weighing assemblies 87, each of which, as seen in FIG. 9, comprises a shear beam strain gauge load cell 88 mounted on an annular ring plate 89 that is supported on posts 90 projecting from the aforementioned main drive gear 44 for support of the rotary filling assembly 45.

The load cells 88 are of generally conventional construction, having a base lock 91 that seats on pins 92 projecting from the ring plate 89 and having a projecting land 93 along the top surface adjacent one side thereof. A main load cell block 94 is attached by bolts 95 to the base block 91 on the land 93 thereof and projects in cantilever fashion at a spacing above the base block 91 toward the other side thereof. Mounted on the main load cell block 94 at the top surface thereof and adjacent the side opposite the land 93 of the base block 91 is a top block 96 having a downwardly facing bottom land 97 that is attached by bolts 98 to the main load cell block 94, with the top block 96 being recessed away from the land 97 to dispose the top block 96 in catilever fashion above the main load cell block 94. With this arrangement, the main load cell block 94 is, in effect, a shear beam, and any weight applied to the top block 96 would create a shear strain in the main block 94 that is developed in a conventional manner into an electrical analog signal transmitted through the electrical connection 99.

To protect the load cell 88 from excessive loads and excessive reaction to the release of loads or the vibration of loading, stop plugs 100 are mounted in the base block 91 and top block 96 for projection in the spacing between these blocks and the main block 94. The stop plugs 100 are adjustably positioned at desired spacings from the main block 94 to limit the amount of relative cantilever movement between the blocks, and limit adjusting screws 101 extend from recesses 102 in the base block 91 and top block 96 into the main block 94 adjacent the stop plugs 100. These limit screws 101 are adjusted so that their heads 103 are at a desired spacing from the bottoms of the recesses 102 to prevent excessive separating movement of the blocks.

The load cells 88 are protected by covers 104 that have top plates 105 seated on pins 106 projecting from the top block 96 and releasably held thereon by a ball detent assembly 107. A peripheral skirt 108 is secured to the top plate 105 and extends downwardly adjacent to ring plate 89. Mounted on the top plate 105 is a bottle supporting plate 109 on which bottles are conveyed as they travel with the bottle filling station around the machine.

The main advantages of using load cells 88 of this general type are that they provide highly accurate weight readings and provide such readings consistently over a fairly wide latitude of bottle locations so that precise centering of the bottles 22 on the load cells 88 is not essential to obtain accurate usable readings.

Supported on the ring plate 89 on hollow posts 110 projecting upwardly therefrom is the aforementioned support ring 61 for the filling head assemblies 57 and a supplemental support ring 111 spaced above the ring plate 89, with the hollow posts 110 extending upwardly for support of a deck 112 above the filling head assemblies 57 and having mounted thereon various components of the filling, pneumatic and electrical circuits as will be described hereinbelow. Mounted on this deck 112 in covering relation to the circuits and to the filling head assemblies 57 is a cylindrical housing 113 with a top cover plate 114.

The liquid material for filling the bottles 22 through the filling head assemblies 57 is fed from a supply (not shown), through supply piping 115 to a point above the machine 20 and in vertical alignment with the axis of rotation thereof. This supply piping 115 extends downwardly and is connected through a union 116 to a rotating input pipe 117 that feeds the liquid from the supply piping 115 into a distribution chamber 118 mounted on a platform 119 spaced above the deck by attachment to an inner support cylinder 120. The distribution chamber 118 is of a conventional construction that distributes the liquid to individual feed lines 121 that project downwardly from the distribution chamber 118 and are connected to each of the filling head assemblies 57 at the input openings 123 of the valves 69, thereby providing the liquid filling material that is dispensed by the filling head assemblies into the bottles 22 upon operation of the valves 69.

The pneumatic circuit by which air under pressure is supplied to the operating cylinders 73 of the filling head assemblies 57 for manipulation of the valve stems 67 to operate the valves 69, receives air under pressure from a supply line 123 from which the air passes through a regulator, filter and gauge assembly 124 and a lubricator 125 to a seal connection 126 located at the bottom of the machine 20 aligned with the axis of the rotating filling assembly 45. The line then extends upwardly and axially through the main drive gear 44 and then radially outward to a dual pressure regulator 127 that has low pressure and high pressure discharges. The high pressure line 128 extends upwardly through one of the hollow posts 110 to the deck 112, through which it extends to a high pressure manifold line that extends around the periphery of the underside of the deck 112, and from which individual lines 130 tap off to a first solenoid 131 at each of the bottle filling stations 86. A low pressure line 132 similarly extends from the dual pressure regulator 127 through one of the posts 110 to the top of the deck 112 and therethrough to a low pressure manifold line extending around the periphery of the underside of the deck 112 and from which low pressure lines 134 are tapped for connection to the first solenoid 131, which is electrically operated to connect its discharge line 135 to either high or low pressure. This discharge line 135 from the first solenoid 131 extends to a second solenoid 136 at the same bottle filling station 86, which is also connected to an exhaust line 137 that is tapped to an exhaust manifold line 138 that is connected to a discharge line 139 extending downwardly through another of the hollow posts 110 for discharge of the exhaust air within the cabinet 25.

The output end of the second solenoid 136 is connected through an operating air line 140 to the operating cylinder 73 to feed either high pressure air or low pressure air thereto for manipulating the vlave for fully open fast initial filling when high pressure is applied, and partially closed slow final filling when low pressure is applied. Further, when the second solenoid is shifted from the discharge line 135 to the exhaust line 137, the operating cylinder 73 is exhausted to allow the springs 71 and 72 to return the valve stem 67 to the valve closed position, thereby shutting off flow of the filling liquid to the bottles 22.

The electrical components and wiring are illustrated in FIGS. 4 and 10–15. Power comes from a convenient supply through a connection, such as a junction box, to a commutator 141 located axially of the rotating filling assembly within the cabinet 25. Also connected to the commutator 141 is the operator console 142 (FIG. 1), which has its control panel 143 visible and accessable by the operator to set the controls therein. A limit switch 144 (FIG. 3) is mounted on a stationary bracket 145 in position for switch operating contact by pins 146 depending from the star wheel 49 of the discharge star assembly 48. The number of pins 146 is equivalent to the number of bottle filling stations 86 on the rotating filling assembly 45 so that the limit switch 144 serves as the activating component of a counter circuit as will be described.

Figure 5:
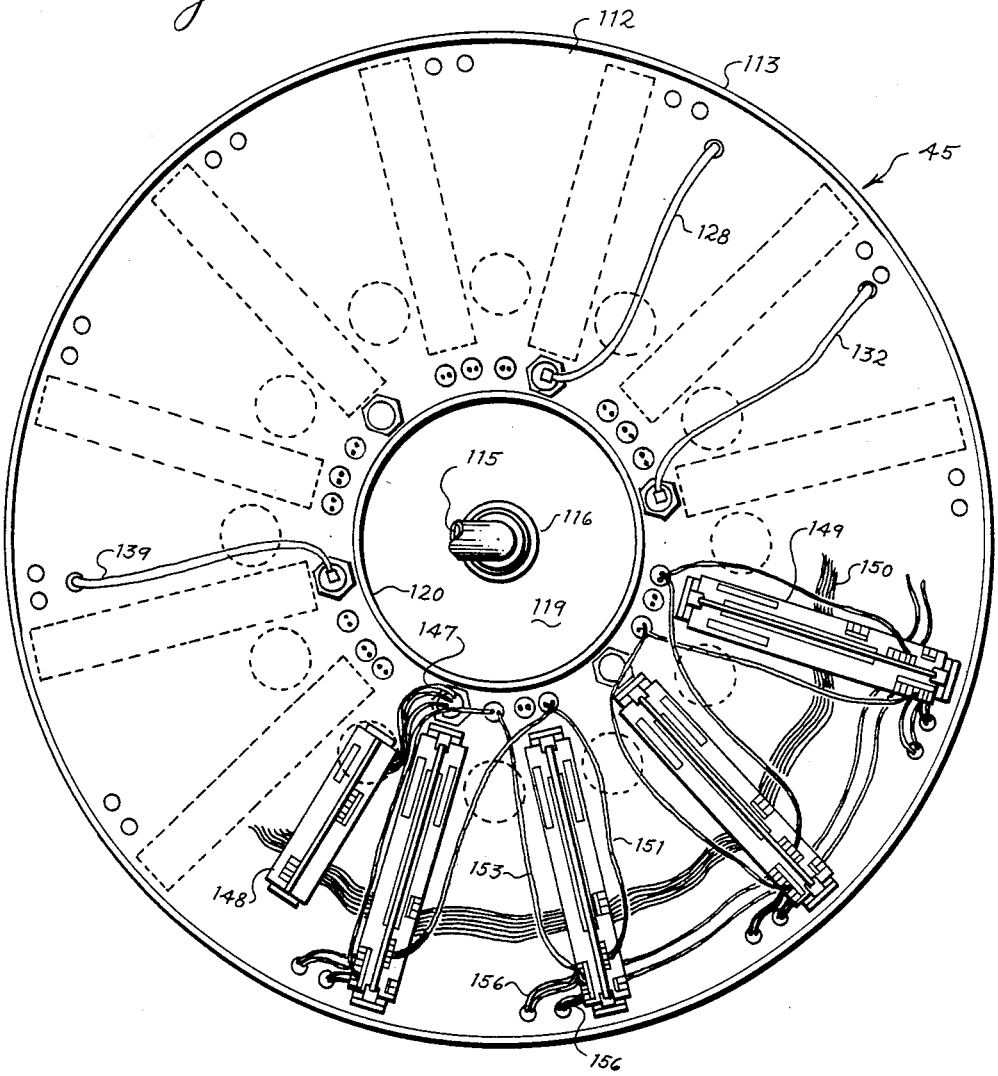
FIG. 5 is a planned view of the rotating conveyor and the components mounted on the upper portion thereof, with the cover removed.
Figure 12:
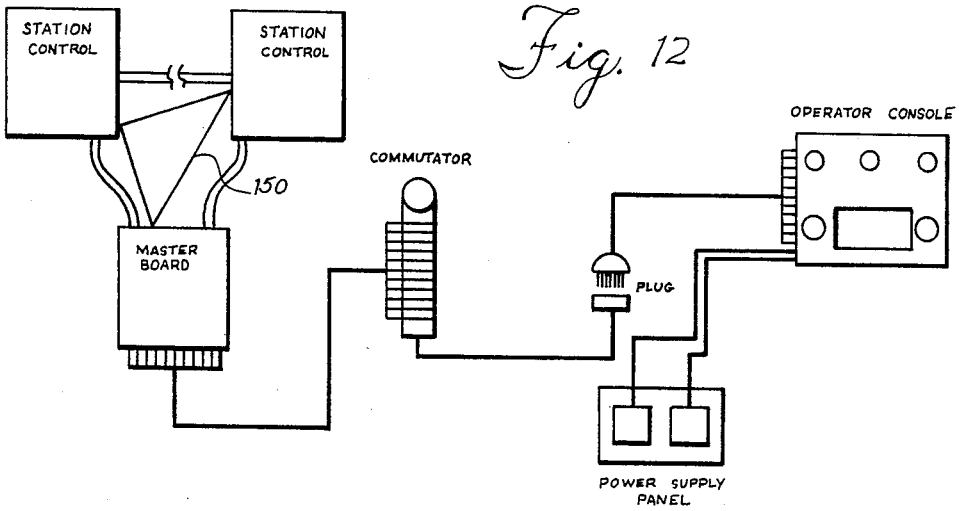
FIG. 12 is a view similar to FIG. 10, showing a variation of the overall electrical diagram.
Figure 6:
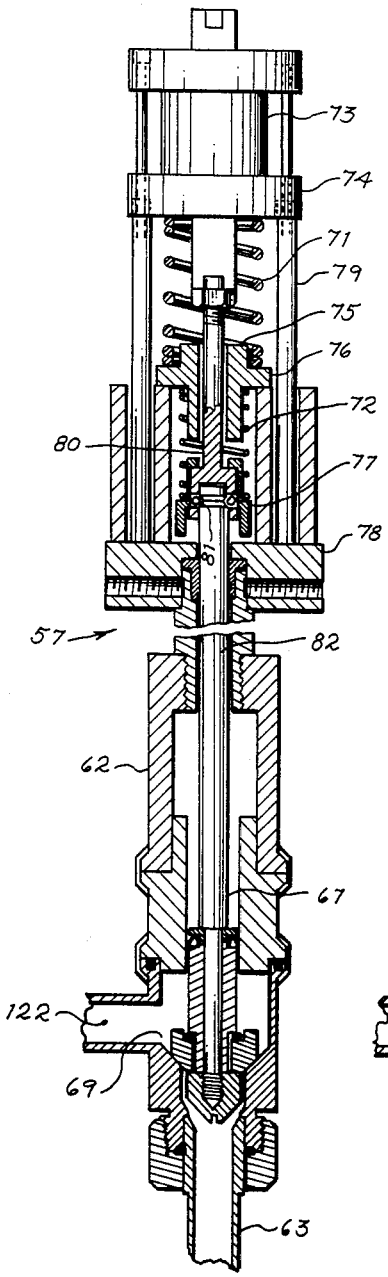
FIG. 6 is a vertical section through the center of one of the filling head assemblies of the machine of FIG. 1 showing the components in the valve closed condition.

The limit switch 144, operator console 142 and power supply are connected to the stationary periphery of the commutator 141, the rotating contacts of which are attached to and driven by the main drive gear 44, with the electrical signals being transferred by the commutator 141 from stationary lines to rotating lines 147 (FIG. 5) that have extended upwardly through ones of the hollow posts 110 that are not being used for airlines and onto the top of the deck 112 for connection to a master electronic circuit board 148 mounted on the deck 112. Also mounted on the deck 112 are separate station electronic circuit boards 149, there being one station board 149 for each bottle filling station 86 on the rotating filling assembly 45. An electrical ribbon cable 150 extends from the master board 148 around the deck 112 to connections to each of the station boards 149 for transfer of electrical power and electronic control signals from the master board 148 to each of the separate station boards 149.

The separate station boards 149 are connected to the load cells 88 at their respective bottle filling stations 86 by lines 151 that extend upwardly through tubes 152 that extend from adjacent the load cells 88 upwardly to the deck 112 from which the lines 151 extend to the associated station board 149, thereby transmitting weighing signals from the load cells 88 to their respective electronic control circuits. These circuits are also connected by lines 153 to limit switches 154 mounted on the aforementioned supplemental support ring 111 in position to be engaged by the filling head assemblies 57 when they reach their lowermost position in readiness for bottle filling operation of their respective valves 69. These lines 153 from the filling head assembly limit switches 154 extend upwardly through tubes 155 through the deck 112 for connection to their respective station boards 149.

The station boards 149 are connected to the solenoids 131 and 136 at their respective bottle filling stations by electrical lines 156 to control operation of the filling head assemblies 57. Also, electrical lines 157 extend between the separate station boards 149 for transmission of control information therebetween.

The operator console 142 constitutes a non-traveling electrical means by which the operator can input control data. For this purpose there are five selectably settable dials on the operator control panel 143. The left hand three dials 158 are settable to provide the data input to indicate a digital signal corresponding to the desired final fill volume or weight desired in the bottles at the completion of the filling cycle. The right hand two dials 159 are settable to indicate the percentage of filling to be done at the high flow rate, at the completion of which the valve 69 is to be manipulated to the slow fill rate for the remainder of the filling operation. When the final fill dials 158 have been set as desired, an input button 160 at the left of the dials is pressed to initiate transmission of the digital signal of that setting to the master board 148. Similarly, when the percentage of fill at high flow is set on the two dials 159, an input button 161 at the right is pressed to activate the transmission of the percentage figure as a digital signal to the master board 148.

The operator control panel 143 also includes a solenoid power button 162, logic power buttons 163 and a test button 164.

Figure 13:
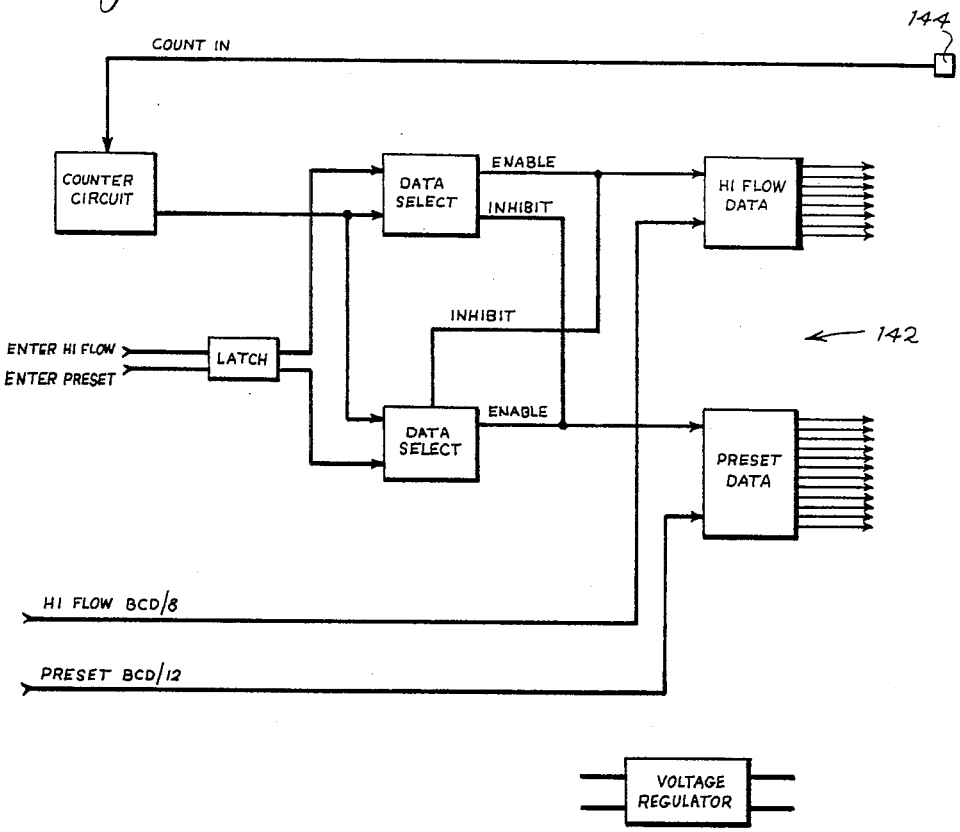
FIG. 13 is a schematic electrical diagram of the operator console of the machine of FIG. 1.

The electrical circuit for the operator console 142 is illustrated diagrammatically in FIG. 13. As seen in this circuit, the final fill setting is transmitted through the Preset line to the preset data bank and the High Flow setting is transmitted to the High Flow Data Bank. When the input buttons 160 and 161 are pressed, they close electrical lines to a Latch that connects to Data Select components that are in turn connected to the high flow data bank and the Preset Data Bank. The Data Select components are also connected to the aforementioned limit switch 144 that is activated by the pins 146 on the star wheel 49 of the discharge star assembly 48 to provide a count signal eqivalent to the number of the bottle filling stations passing a given point, so that a count of the same number as there are bottle filling stations will provide an indication that the rotary filling assembly 45 has completed one revolution. The signal from the limit switch 144 is transmitted to a Counter Circuit that is connected to both Data Select components, with the component for the Preset Data Bank enabling transmission of the final fill setting signal through the commutator 141 to the master circuit board 148 upon the first count from the limit switch 144, which condition is maintained until the Counter Circuit determines that it has received the number of signals from the limit switch 144 to indicate that a full cycle of the rotating filling assembly 45 has been completed. During this period, the Data Select Component for the Preset Data Bank has sent an inhibiting signal to the High Flow Data Bank so that percentage setting signals are not transmitted to the master circuit board 148.

After one full cycle of revolution has been counted by the Counter Circuit and fed to the Data Select components, the signals from the components reverse to enable the High Flow Data Bank to transmit the percentage setting at which the valve changes from high flow to low flow to the master circuit board 148 and the transmission of the final fill setting is terminated at the Preset Data Bank. A Voltage Regulator is also included or associated with the operator console 142 to regulate the transmission of the power supply to the master circuit board 148.

Figure 14:
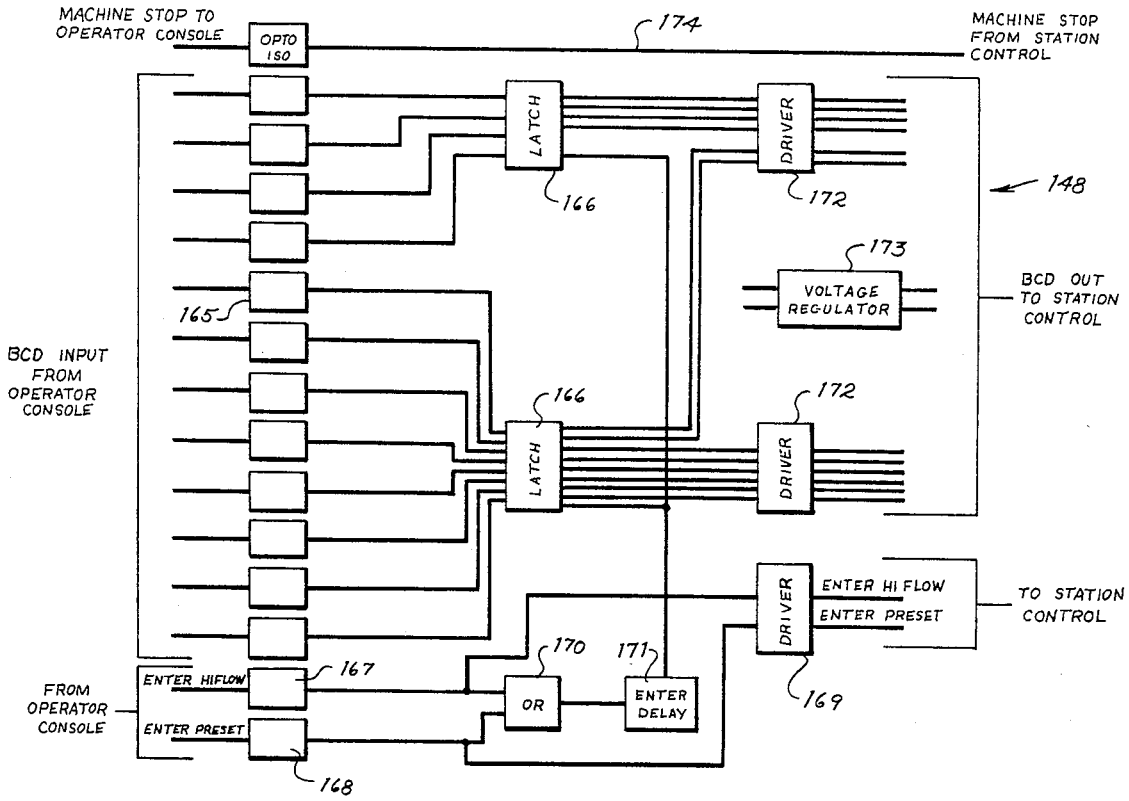
FIG. 14 is a schematic electrical diagram of the master board circuit of the machine of FIG. 1.
Figure 15:
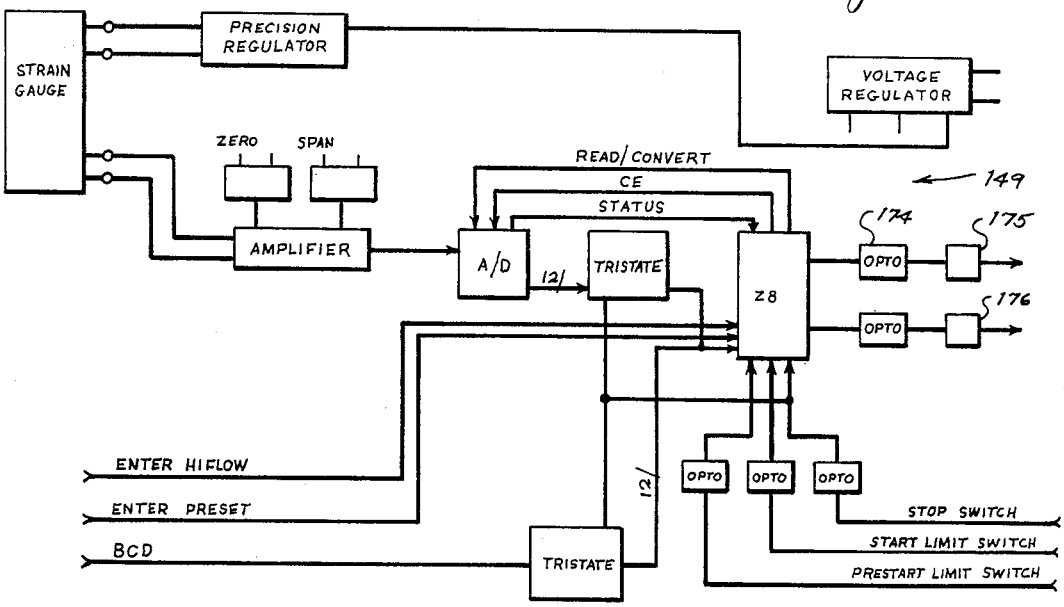
FIG. 15 is a schematic electrical diagram of the electrical circuit of the separate station boards of the machine of FIG. 1.

The master circuit board 148 is illustrated diagrammatically in FIG. 14, which shows twelve input signal receiving components 165, all twelve of which are used for receiving the full fill or preset value digital signals and eight are used for the high flow or percentage digital signals. These components 165 received the BCD signals and transmit them to two latches 166, which prevent transmission therebeyond of the signals until activated. There is also a signal receiving component 167 that receives the signal that high flow or percentage digital signals are being transmitted, and a final fill or preset signal receiving component 168 that receives and transmits a signal indicating that the digital signals for final fill or preset are being transmitted. These latter two components 167 and 168 transmit their signal to a driver 169 that sends a signal to the separate station boards 149 indicating that one or the other type of digital signals will be transmitted. These signals from the receiving components 167 and 168 are also connected to an OR gate 170 that is connected to a delay component 171 that holds the latches 166 closed momentarily so that the instructional signals can be sent to the station boards 149 before the digital data signals are sent through drivers 172.

The master board 148 also includes a voltage regulator 173 that refines the power signals from the commutator to the station boards 149 so that an accurate and consistent power signal can be supplied to the station boards 149 without variations and deviations that may have been imposed during transmission of the power supply signals across the commutator 141. The master board 148 further includes a line 174 connected back from the station boards 149 that indicates a stop condition due to the absence of a bottle at the filling position or the presence of an already partially filled bottle or some other circumstance that indicates that the machine should be stopped. This signal passes through an optical isolator (OPTO) 174 to the operator console 142.

Each station board 149 receives the BCD output form the master board 148 which is received in twelve bit form into a Tristate component. This BCD input is received by all of the station boards 149 at the same time, as is the signal from the master board 148 that indicates whether the digital signal is for the final fill information or the high flow percentage information. These latter two signals are fed into a microcomputer chip, which in the preferred embodiment is a Zilog Z8 chip, but any other suitable conventionally available chip could be utilized. The Tristate component stores the information until activation of the cunter limit switch 144 by the pin 146 corresponding to that satation and at that time transmits the twelve bit BCD signal to the Z8 chip. This first Tristate component is connected to another Tristate component, with these components being active on an either/or basis such that when the new BCD signals are entering the first Tristate component it is active, and when the BCD signals have been transmitted to the Z8 chip the activity of the Tristate components reverses so that the other Tristrate component transmits its signal to the Z8 chip.

With this circuitry, when an operator changes the control data for the final fill or the high flow value and presses the appropriate button, the twelve bit signal passes through the commutator and master board to the station boards, with the signals being accompanied by a signal indicating whether the digital information is for final fill or high flow control. The change of the control signals, while being received at the same time by all station boards is retained at each station board and activated only sequentially at a selected location of the filling station corresponding to the station board so that the change in control data is activated at each station board at the same rotational position of the rotating filling assembly.

The Z8 chip serves to compare the BCD control signals for final fill values and high flow values with signals being received indicating the actual fill conditions in the bottle at the corresponding station. This is done through signals received from the load cell. For this purpose, the strain gauge of the load cell receives power in many volts from a Precision Regulator that receives power from a Voltage Regulator that has stepped the main power supply down and filtered and refined it so that when it is further regulated by the Precision Regulator the millivolt signal to the Strain Gauge will be highly precise and invariable to assure accurate and highly precise signals from the Strain Gauge responsive only to the weight of the bottle on the load cell at that station without extraneous variations or interference.

The signals from the Strain Gauge are received by an amplifier that amplifies the signals to values usable in the remainder of the station control circuit. Also, initial adjustments are made in the amplifier in relation to the Strain Gauge readings during calibration testing to shift the amplification range through the Zero control so that the signal from the Strain Gauge when the load cell is empty will be an output signal from the Amplifier that the Z8 chip will recognize as an empty station signal, and the range of the same strength as at other stations of the amplification will be similarly initially adjusted through the Span controlduring calibration to provide a range for the amplified signal similar to the ranges at the other stations.

The signal from the Strain Gauge is a analog signal corresponding to the weight being applied to the Strain Gauge of the load cell. This analog signal is converted to a digital signal by an A/D component with conventional operational connection with the Z8 chip to accomplish this. The converted digital signal is transmitted from the A/D converter as a twelve bit digital signal to the aformentioned Tristate component that, when the other Tristate is inactive, transmits the digital Strain Gauge reading signal to the Z8 chip, which compares the Strain Gauge signals with the control signals on a frequency of milliseconds to provide an output for operation of the aforementioned solenoids 131 and 132. The Z8 chip is inactive to transmit an operating signal to the solenoids until it receives a signal from the corresponding limit switch 154 that indicates that the filling head assembly is in a filling position in respect to a bottle on the load cell. This signal comes through the Start Limit Switch line illustrated in the station board circuit of FIG. 15. The Z8 chip does not activate upon receiving this start signal unless it had previously determined that here was something on the load cell in the range of the weight of an empty bottle to positions in advance of the station arriving at the location where the filling head assembly had been lowered into the bottle. This preliminary weighing determination is made by a signal received from a limit switch at a station two locations in advance, with the signal from the advance limit switch being received by the Z8 chip through the Prestart Limit Switch line. When the Z8 chip gets the start signal, it activates the circuit 176 of the second solenoid 136 to switch the solenoid from exhaust to pressure positions to apply the high pressure coming through the first solenoid 131 to the valve 69 to cause full fast feed operation of the flow of fill liquid to the bottle. When the Z8 chip has determined that the Strain Gauge signals are equal to the control data signals, indicating that the fill has reached the percentage at which the rate should change to slow feed, the Z8 chip activates the circuit 175 for the first solenoid 131 to switch it from high pressure to low pressure, thereby shifting the valve 69 to the partially closed, slow feed position. When the Z8 chip has determined that the Strain Gauge signals are equal to the final or full fill control data, it de-energizes both the circuit 175 for the first solenoid 131 and the circuit 176 for the second solenoid 136 so that the second solenoid switches to the exhaust side to effect valve closure and the first solenoid 131 shifts to the high pressure side in readiness for the next filling cycle.

In the event full filling has not occurred prior to the station reaching the location where the filling head assembly is to be raised out of the bottle to allow the bottle to be removed from the rotating filling head assembly, the initial upward movement of the filling head assembly 57 will disengage the limit switch 154 to send a signal through the Stop Switch line to cause the Z8 chip to de-energize the solenoid circuits 175 and 176, to effect closing of the valve 69.

The Z8 chip includes the capability of eliminating false or misleading weight readings due to fluctuations caused by filling disturbances or turbulences of the liquid or other causes by determining an average rate of fill determined by comparing a plurality, such as sixteen, of the most recent weigh readings and using that average to predict the point at which the bottle will have been filled to the preset amount, at which point the Z8 chip will effect closing of the valve 69. This could also be accomplished with even greater reliability by programming a microchip to use a sum of the least squares in determining a theoretical filling rate.

The Strain Gauge readings and resultant signals to the Z8 chip continue after the valve 69 has closed to provide the Z8 chip with a reading of the actual fill, which may be more or less than the intended controlled fill due to the timing of the action of the valve 69, the circuit acting time, or any other extraneous reason. The Z8 chip includes the capability to determine the difference between the actual fill amount and the control data and applies a portion of that difference as a correction for the subsequent cycle to de-energize the solenoids and close the valve 69 at an earlier or later increment in relation to the over fill or under fill determination.

The particular details of the circuitry of the Z8 chip to accomplish the functions described are conventional and need not be described herein as they can be utilized to perform these functions by anyone skilled in the art.

With the electrical and electronic circuitry as described, the load cells 88 and associated components comprise sensing means that provides a sensed signal to the separate electronic circuit means of the station boards where the sensed signal is compared with a preset selected signal to provide a responsive signal that is used to control the feeding operation, with the preset selected signal being capable of change during operation and being sequentially transmittable to the separate station boards. In addition, the preset signals can be stored and sequentially distributed by the master electronic circuit of the master board.

The use of separate control circuits for each station, with the electronic circuits mounted for rotation with the stations, provides individualized and instantaneous response at each station to filling conditions and changes therein, while still receiving control signals from a non-traveling input electrical circuit. In addition, the use of separate station control circuits rotating with the stations allow the individual control circuits to be isolated from the effects of transferring the electrical signals from a stationary to a rotating circuit with an associated interference and deviations. It also allows for alteration of the performance of each individual station without requiring mechanical adjustment and with the control being at the speed of electronic circuitry rather than at the slow speed of mechanical, hydraulic or pneumatic control operation. The resulting filling control is highly accurate as the machine is capable of controlling and sensing at the gram level even when filling large containers that have a filled weight of several pounds or more.

In the operation at each station, a tear weight signal is first received from the load cell by signal initiated upon closing of the limit switch of the station two places in advance. Then, when the station reaches the limit switch position an empty bottle weight signal is transmitted by load cell and compared in the Z8 chip with a minimum value to indicate that something other than or no bottle is on the station and is compared with a maximum signal to determine whether a partially filled bottle or some other object is on the station. In either excessive condition, the circuit stops the operation without instituting filling. The filling cycle as described above then proceeds, and when throttling of the feed occurs by changing of the solenoids to connect low pressure air to the valve operating cylinder, the Z8 chip starts averaging of the readings to determine an average rate of fill, which it projects to a valve closing time, before which the solenoids are activated to compensate for the filling that will occur during the time the valve is being finally closed. This prior actuation can be initially programmed and can also be adjusted from filling operation to filling operation by the Z8 chip applying a proportional amount of the difference between the actual reading of the last fill in comparison with the control value for the final fill.

When a change in the final fill amount is to be imposed during operation, the signal is transmitted to each separate station board for input only when the station board reaches a selected location in its rotary path so that the change does not disrupt a filling operation and will be completed for all of the stations in one revolution of the rotating filling assembly.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. In a container handling apparatus having an endless conveyor on to which containers are sequentially placed and transported on individual container stations of the conveyor, means for providing an indication of the extent to which each container has been filled with material in comparison with a preset selected filled extent comprising a separate means traveling with each individual container station for sensing the extent to which the container at said station has been filled and providing an electrical signal corresponding thereto, a separate electronic circuit means traveling with each individual container station, non-traveling electrical means separate from said conveyor and being selectively settable to provide an electrical signal corresponding to said selected filled extent for said containers, means electrically connecting said non-traveling electrical settable means with each of said traveling separate electronic circuit means to transmit said selected electrical signal to each of said separate electronic circuit means, said separate electronic circuit means comparing said electrical signal corresponding to the sensed extent to which the container at said station has been filled with said selected electrical signal and providing an electrical signal in response to the comparison to indicate the deviation of the extent to which the contaner is filled from the selected filled extent.

2. In a container handling apparatus, means for providing a comparison indication of the extent of fill of each container according to claim 1 and characterized further in that the setting of said non-traveling selectively settable electrical means is changeable during travel of said conveyor, and said electrically connecting means transmits a changed setting signal from said electrical settable means to said separate electronic circuit means.

3. In a container handling apparatus, means for providing a comparison indication of the extent of fill of each container according to claim 1 and characterized further in that said electrically connecting means transmits said changed setting signal to said separate electronic circuit means sequentially during a cycle of said traveling conveyor.

4. In a container handling apparatus, means for providing a comparison indication of the extent of fill of each container according to claim 2 and characterized further in that each of said separate electronic circuit means includes means for latching said electrical signal from said connecting means for continued operation at the latched signal valve until a subsequent charged signal is received.

5. In a container handling apparatus, means for providing a comparison indication of the extent of fill of each container according to claim 2 and characterized further in that said electrically connecting means includes electrical commutator means connected to said traveling conveyor for transmission of said selected electrical signal to said traveling conveyor for transmission of said selected electrical signal to said traveling separate electronic circuit means.

6. In a container handling apparatus, means for providing a comparison indication of the extent of fill of each container according to claim 5 and characterized further in that said commutator means transmits electrical power from a source to said traveling separate electronic circuit means.

7. In a container handling apparatus, means for providng a comparison indication of the extent of fill of each container according to claim 5 and characterized further in that said electrically connecting means includes means for regulating the electrical signals transmitted from said commutator means to said separate electronic circuit means to minimize extraneously imposed variations in said signals.

8. In a container handling apparatus, means for providing a comparison indication of the extent of fill of each container according to claim 1 and characterized further in that each of said separate sensing means comprises a shear beam strain gauge load cell mounted at each conveyor station for weighing support of containers thereon and providing an electrical signal to said separate electronic circuits means corresponding to the weight sensed.

9. In a container handling apparatus, means for providing a comparison indication of the extent of fill of each container according to claim 1 and characterized further in that said electrically connecting means includes a master electronic circuit means mounted on said conveyor for travel therewith and connected to each of said separate station electronic circuit means for distribution of said selected electrical signal to each of said separate station electronic circuit means.

10. In a container handling apparatus, means for providing a comparison indication of the extent of fill of each container according to claim 9 and characterized further in that the setting of said non-traveling selectively settable electrical means is changeable during travel of said conveyor, and said master electronic circuit means transmits a charged setting signal to said separate electronic circuit means sequentially during a cycle of said traveling conveyor.

11. In a container handling apparatus, means for providing a comparison indication of the extent of fill of each container according to claim 10 and characterized further in that each of said separate electronic circuit means includes means for latching said electrical signal from said master electronic circuit means for continued operation at the latched signal valve until a subsequent charged signal is received.

12. In a container handling apparatus, means for providing a comparison indication of the extent of fill of each container according to claim 9 and characterized further in that said master electronic circuit means includes means for storing received selected electrical signals and subsequently transmitting said stored signals to said separate electronic circuit means sequentially during a cycle of said traveling conveyor.

13. In a container handling apparatus, means for providing a comparison indication of the extent of fill of each container according to claim 9 and characterized further in that said electrically connecting means includes electrical commutator means connected to said traveling conveyor for transmission of said selected electrical signal to said master electronic circuit means.

14. In a container handling apparatus, means for providing a comparison indication of the extent of fill of each container according to claim 13 and characterized further in that said commutator means transmits electrical power from a source to said master electronic circuit means.

15. In a container handling apparatus, means for providing a comparison indication of the extent of fill of each container according to claim 13 and characterized further tin that said master electronic circuit means includes means for regulating the electrical signals transmitted from said commutator means through said master electronic circuit means to said separate electronic circuit means to minimize extraneously imposed variations in said signals.

16. In a container handling apparatus, means for providing a comparison indication of the extent of fill of each container according to claim 9 and characterized further in that each of said separate sensing means comprises a shear beam strain gauge load cell mounted at each conveyor station for weighing support of containers thereon and providing an electrical signal to said separate electronic circuit means corresponding to the weight sensed.

17. In an apparatus for filling containers with material that is dispensed from a supply through flow control means into containers traveling sequentially on an endless conveyor that has individual container stations, means for controlling said flow control means to stop filling of each container in relation to a preset selected filled extent comprising a separate means traveling with each individual container station for sensing the extent to which the container at said station has been filled and providing an electrical signal corresponding thereto, a separate electronic circuit means traveling with each individual container station for receiving the signal from the sensing means at the same station, means providing an electrical signal corresponding to a desired filled extent for said containers, said separate electronic circuit means comparing said electrical signal corresponding to the sensed extent to which the container at said station has been filled with said electrical signal corresponding to the desired filled extent and providing an electrical signal to said flow control means in response to the comparison to cause said flow control means to stop filling of the container at the station when the filled extent corresponds with the desired filled extent.

18. In an apparatus for filling containers, controlling means according to claim 17 and characterized further in that said means providing an electrical signal corresponding to a desired extent fill is selectively settable and is a single means providing said signal to all of said separate electronic circuit means.

19. In an apparatus for filling containers, controlling means according to claim 17 and characterized further in that each of said separate sensing means comprises a shear beam strain gauge load cell mounted at each conveyor station for weighing support of containers thereon and providing an electrical signal to said separate electronic circuit means corresponding to the weight sensed.

20. In an apparatus for filling containers, controlling means according to claim 17 and characterized further in that each said separate electronic circuit means further compares the electrical signal from said sensing means after filling has stopped with said preset signal and applies a corresponding compensating adjustment to the subsequent electrical signal to said flow control means.

21. In an apparatus for filling containers, controlling means according to claim 20 and characterized further in that said corresponding compensating adjustment is determined to correspond to the average difference indicated by a preceding plurality of comparisons.

22. In an apparatus for filling containers, controlling means according to claim 20 and characterized further in that said compensation adjustment is determined to be a portion of the difference obtained by said after filling comparison.

23. In an apparatus for filling containers, controlling means according to claim 17 and characterized further in that said separate electronic circuit means determines the average rate of fill from a plurality of the electrical signals from said sensing means as said signals approach said desired extent of fill signal and provides said electrical signal to said flow control means in response to a comparison of the average rate of fill with said desired extent of fill signal, thereby minimizing any extraneously caused deviations in said fill extent sensing.

24. In an apparatus for filling containers, controlling means according to claim 17 and characterized further in that said means for providing a desired extent of fill signal includes non-traveling electrical means separate from said conveyor and being selectively settable to provide said desired extent of fill signal, and means electrically connecting said non-traveling electrical settable means with each of said traveling separate electronic circuit means to transmit said desired extent of fill signal to each of said separate electronic circuit means.

25. In an apparatus for filling containers, controlling means according to claim 24 and characterized further in that the setting of said non-traveling selectively settable electrical means is changeable during travel of said conveyor, and said electrically connecting means transmits a changed setting signal from said electrical settable means to said separate electronic circuit means.

26. In an apparatus for filling containers, controlling means according to claim 25 and characterized further in that said electrically connecting means transmits said changed setting signal to said separate electronic circuit means sequentially during a cycle of said traveling conveyor.

27. In an apparatus for filling containers, controlling means according to claim 25 and characterized further in that each of said separate electronic circuit means includes means for latching said electrical signal from said connecting means for continued operation at the latched signal valve until a subsequent charged signal is received.

28. In an apparatus for filling containers, controlling means according to claim 24 and characterized further in that said electrically connecting means includes electrical commutator means connected to said traveling conveyor for transmission of said selected electrical signal to said traveling conveyor for transmission of said selected electrical signal to said traveling separate electronic circuit means.

29. In an apparatus for filling containers, controlling means according to claim 28 and characterized further in that said commutator means transmits electrical power from a source to said traveling separate electronic circuit means.

30. In an apparatus for filling containers, controlling means according to claim 28 and characterized further in that said electrically connecting means includes means for regulating the electrical signals transmitted from said commutator means to said separate electronic circuit means to minimize extraneously imposed variations in said signals.

31. In an apparatus for filling containers, controlling means according to claim 24 and characterized further in that each of said separate sensing means comprises a shear beam strain gauge load cell mounted at each conveyor station for weighing support of containers thereon and providing an electrical signal to said separate electronic circuit means corresponding to the weight sensed.

32. In an apparatus for filling containers, controlling means according to claim 24 and characterized further in that said electrically connecting means includes a master electronic circuit means mounted on said conveyor for travel therewith and connected to each of said separate station electronic circuit means for distribution of said selected electrical signal to each of said separate station electronic circuit means.

33. In an apparatus for filling containers, controlling means according to claim 32 and characterized further in that the setting of said non-traveling selectively settable electrical means is changeable during travel of said conveyor, and said master electronic circuit means transmits a charged setting signal to said separate electronic circuit means sequentially during a cycle of said traveling conveyor.

34. In an apparatus for filling containers, controlling means according to claim 33 and characterized further in that each of said separate electronic circuit means includes means for latching said electrical signal from said master electronic circuit means for continued operation at the latched signal valve until a subsequent charged signal is received.

35. In an apparatus for filling containers, controlling means according to claim 32 and characterized further in that said master electronic circuit means includes means for storing received selected electrical signals and subsequently transmitting said stored signals to said separate electronic circuit means sequentially during a cycle of said traveling conveyor.

36. In an apparatus for filling containers, controlling means according to claim 32 and characterized further in that said electrically connecting means includes electrical commutator means connected to said traveling conveyor for transmission of said selected electrical signal to said master electronic circuit means.

37. In an apparatus for filling containers, controlling means according to claim 36 and characterized further in that said commutator means transmits electrical power from a source to said master electronic circuit means.

38. In an apparatus for filling containers, controlling means according to claim 36 and characterized further in that said master electronic circuit means includes means for regulating the electrical signals transmitted from said commutator means through said master electronic circuit means to said separate electronic circuit means to minimize extraneously imposed variations in said signals.

39. In an apparatus for filling containers, controlling means according to claim 32 and characterized further in that each of said separate sensing means comprises a shear beam strain gauge load cell mounted at each conveyor station for weighing support of containers thereon and providng an electrical signal to said separate electronic circuit means corresponding to the weight sensed.

40. In a rotary filling machine that has a rotating conveyor with filling stations on which containers are supported and into which liquid is dispensed through filling head assemblies at each individual station, with the filling head assemblies having valve means for controlling the flow of liquid therethrough, means for controlling the operation of said valve means to stop filling of each container in relation to a preset selected filled extent comprising a separate means traveling with each individual container station for sensing the extent to which the container at said station has been filled and providing an electrical signal corresponding thereto, a separate electronic circuit means traveling with each individual container station for receiving the signal from the sensing means at the same station, non-traveling electrical means separate from said conveyor and being selectively settable to provide an electrical signal corresponding to a desired filled extent for said containers, means electrically connecting said non-traveling electrically settable means with each of said traveling separate electronic circuit means to transmit said selected electrical signal to each of said separate electronic circuit means, said electrical connecting means including a master electronic circuit means mounted on said conveyor for travel therewith and connected to each of said separate station electronic circuit means for distribution of said selected electronic signal to each of said separate station electronic circuit means, said separate electronic circuit means comparing with said electrical signal corresponding to the sensed extent to which the container at said station has been filled with said electrical signal corresponding to the desired filled extent and providing an electrical signal to said valve means in response to the comparison to cause said valve means to close to stop filling of the container at the station when the filled extent corresponds with the desired filled extent.

41. In a rotating filling machine, controlling means according to claim 40 and characterized further in that each said separate electronic circuit means further compares the electrical signal from said sensing means after filling has stopped with said preset signal and applies a corresponding compensating adjustment to the subsequent electrical signal to said valve means.

42. In a rotating filling machine, controlling means according to claim 41 and characterized further in that said corresponding compensating adjustment is determined to correspond to the average difference indicated by a preceding plurality of comparisons.

43. In a rotating filling machine, controlling means according to claim 41 and characterized further in that said compensating adjustment is determined to be a portion of the difference obtained by said after filling comparison.

44. In a rotating filling machine, controlling means according to claim 41 and characterized further in that said separate electronic circuit means determines the average rate of fill from a plurality of the electrical signals from said sensing means as said signals approach said desired extent of fill signal and provides said electrical signal to said valve means in response to a comparison of the average rate of fill with said desired extent of fill signal, thereby minimizing any extraneously caused deviations in said fill extent sensing.

45. In a rotating filling machine, controlling means according to claim 40 and characterized further in that the setting of said non-traveling selectively settable electrical means is changeable during travel of said conveyor, and said master electronic circuit means transmits a charged setting signal to said separate electronic circuit means sequentially during a cycle of said traveling conveyor.

46. In a rotating filling machine, controlling means according to claim 45 and characterized further in that each of said separate electronic circuit means includes means for latching said electrical signal from said master electronic circuit means for continued operation at the latched signal valve until a subsequent charged signal is received.

47. In a rotating filling machine, controlling means according to claim 40 and characterized further in that said master electronic circuit means includes means for storing received selected electrical signals and subsequently transmitting said stored signals to said separate electronic circuit means sequentially during a cycle of said traveling conveyor.

48. In a rotating filling machine, controlling means according to claim 40 and characterized further in that said electrically connecting means includes electrical commutator means disposed axially with respect to said rotating conveyor for transmission of said selected electrical signal to said master electronic circuit means.

49. In a rotating filling machine, controlling means according to claim 48 and characterized further in that said commutator means transmits electrical power from a source to said master electronic circuit means.

50. In a rotating filling machine, controlling means according to claim 48 and characterized further in that said master electronic circuit means includes means for regulating the electrical signals transmitted from said commutator means through said master electronic circuit means to said separate electronic circuit means to minimize extraneously imposed variations in said signals.

51. In a rotating filling machine, controlling means according to claim 40 and characterized further in that each of said separate sensing means comprises a shear beam strain gauge load cell mounted at each conveyor station for weighing support of containers thereon and providng an electrical signal to said separate electronic circuit means corresponding to the weight sensed.

* * * * *

UNITED STATES PATENT OFFICE

CERTIFICATE OF CORRECTION

Patent No. 4,582,102 Dated April 15, 1986

Inventor(s) James A. Risser

It is certified that error appears in the above-identified patent and that said Letters Patent are hereby corrected as shown below:

Column 4, line 2, delete "congtrolling" and insert therefor — controlling — .
Column 7, line 34, delete "catilever" and insert therefor — cantilever — .
Column 11, line 37, delete "form" and insert therefor — from — .
Column 11, line 47, delete "cunter" and insert therefor — counter — .
Column 11, line 48, delete "satation" and insert therefor — station — .
Column 12, line 55, delete "here" and insert therefor — there — .
Column 16, line 1, delete "circuits" and insert therefor — circuit — .
Column 16, line 54, delete "tin" and insert therefor — in — .
Column 17, line 54, delete "compensation" and insert therefor — compensating — .

Signed and Sealed this

Fourth Day of November, 1986

[SEAL]

*Attest:*

DONALD J. QUIGG

*Attesting Officer*

*Commissioner of Patents and Trademarks*